US011885061B2

(12) United States Patent
Anburaj et al.

(10) Patent No.: US 11,885,061 B2
(45) Date of Patent: Jan. 30, 2024

(54) WASHING MACHINE APPLIANCE SPACER ASSEMBLY

(71) Applicant: Haier US Appliance Solutions, Inc., Wilmington, DE (US)

(72) Inventors: Ravikumar Anburaj, Tamilnadu (IN); Sushant Maruti Bhogulkar, Hyderabad (IN); Srikanth Gopireddy, Hyderabad (IN); Pavan Kumar Madeti, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/842,934

(22) Filed: Jun. 17, 2022

(65) Prior Publication Data

US 2023/0407546 A1 Dec. 21, 2023

(51) Int. Cl.
*D06F 39/00* (2020.01)
*D06F 39/12* (2006.01)

(52) U.S. Cl.
CPC ..... *D06F 39/001* (2013.01); *D06F 39/12* (2013.01)

(58) Field of Classification Search
CPC ..... D06F 39/001; D06F 39/12
USPC ..... 68/3 R
See application file for complete search history.

(56) References Cited

U.S. PATENT DOCUMENTS 4,070,048 A * 1/1978 Young ..... E05B 65/1033 292/179
5,123,619 A * 6/1992 Tomlinson ..... H02G 3/26 248/292.12
7,207,908 B1 * 4/2007 Gizowski ..... F42B 6/08 473/583
10,837,136 B2 11/2020 Rineer et al.
2004/0118167 A1 * 6/2004 Kim ..... D06F 39/001 68/3 R (Continued)

FOREIGN PATENT DOCUMENTS

CA 2092151 A1 10/1993
CN 102020004 B 4/2013

(Continued)

OTHER PUBLICATIONS

MiSUMi, "Beating Shaft Screws with Retaining Ring Grover—Bolt (MiSUMi)", Retrieved on Jun. 6, 2022, https://us.misumi-ec.com/vona2/detail/110300115170/?curSearch=%7b%22field%22%3a%22%40search%22%2c%22seriesCode%22%3a%22110300115170%22%2c%22innerCode%22%3a%22%22%2c%22sort%22%3a1%2c%22specSortFlag%22%3a0%2c%22allSpecFlag%22%3a0%2c%22page%22%3a1%2c%22pageSize%22%3a%2260%22%7d&Tab=wysiwyg_area_0, 4 pages.

*Primary Examiner* — David G Cormier
*Assistant Examiner* — Thomas Bucci
(74) *Attorney, Agent, or Firm* — Dority & Manning, P.A.

(57) ABSTRACT

A washing machine appliance is provided, including a cabinet having a rear panel, a wash tub located within the cabinet, and a shipping spacer assembly. The shipping spacer assembly is removably attached to the wash tub for fixing a distance between the wash tub and the cabinet in an installed position. The shipping spacer assembly includes a bolt, a spacer, and a locking mechanism. The bolt includes a shaft extending along an axial direction, and a head located at one end of the shaft. The bolt defines a lock-receiving feature along the shaft. The spacer defines a bolt cavity extending along the axial direction and removably receives the shaft. The locking mechanism removably engages the bolt at the lock-receiving feature to secure the spacer to the bolt.

20 Claims, 6 Drawing Sheets

(56) References Cited

U.S. PATENT DOCUMENTS

| | | | | |
|---|---|---|---|---|
| 2004/0237602 | A1* | 12/2004 | Lappoehn | D06F 39/001 68/213 |
| 2013/0305789 | A1* | 11/2013 | Sul | D06F 37/264 68/139 |
| 2016/0300183 | A1 | 10/2016 | Berger et al. | |
| 2018/0105968 | A1* | 4/2018 | Lee | D06F 37/06 |
| 2019/0338456 | A1* | 11/2019 | Pacho Millán | F16B 21/09 |
| 2020/0199802 | A1* | 6/2020 | Rineer | B65D 85/68 |
| 2021/0079948 | A1* | 3/2021 | Xie | F16B 19/02 |
| 2021/0198830 | A1 | 7/2021 | Chun et al. | |

FOREIGN PATENT DOCUMENTS

| | | | |
|---|---|---|---|
| CN | 102305947 | B | 7/2013 |
| CN | 102048568 | B | 8/2014 |
| CN | 204099377 | U | 1/2015 |
| CN | 206000833 | U | 3/2017 |
| CN | 213447701 | U | 6/2021 |
| EP | 2313330 | B1 | 1/2017 |
| ES | 2216916 | T3 | 11/2004 |
| ES | 2262736 | T3 | 12/2006 |

* cited by examiner

WASHING MACHINE APPLIANCE SPACER ASSEMBLY

FIELD OF THE INVENTION

The present subject matter relates generally to appliances, and more particularly to washing machine appliances.

BACKGROUND OF THE INVENTION

Washing machine appliances generally include a wash tub housed within a cabinet. A wash basket is rotatably mounted within the wash tub and defines a wash chamber for receipt of articles for washing during a wash cycle. During the wash cycle, the wash basket rotates and agitates articles or wash fluid to wash the articles. The wash tub may move or vibrate within the cabinet during the wash cycle. One or more suspension devices of the washing machine appliance may suspend the wash tub within the cabinet and allow some movement relative to the cabinet during operation. The suspension devices generally allow the tub to move relative to the cabinet during operation of the washing machine appliance.

Notably, vibrations that may be experienced during the transportation of the washing machine appliance may overwhelm the suspension devices, resulting in premature wear or damage to one or more components of the appliance. Accordingly, shipping bolts and spacers are commonly used to secure the tub to the cabinet to make the washer rigid and to ensure the safe handling of the washing machine appliance during shipping or other transport. After the washing machine appliance is installed, the shipping bolts and spacers should be removed prior to operating the machine. However, sometimes the shipping bolts and spacers are inadvertently left in the washer at the time of installation. If these bolts and spacers are not removed, the suspensions of the wash tub will not be activated and there will be a lot of noise and vibration. These issues result in customer dissatisfaction, damage to the appliance or surrounding property, or additional service visits or maintenance costs.

Accordingly, measures for simplifying the installation and transport of washing machine appliances would be desirable. Additionally or alternatively, a stabilization measure that entices its removal from the wash tub prior to use of the washing machine appliance would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a washing machine appliance is provided. The washing machine appliance may include a cabinet having a rear panel, a wash tub located within the cabinet, and a shipping spacer assembly. The shipping spacer assembly may be removably attached to the wash tub for fixing a distance between the wash tub and the cabinet in an installed position. The shipping spacer assembly defines an axial direction, a radial direction, and a circumferential direction. The shipping spacer assembly includes a bolt, a spacer, and a locking mechanism. The bolt includes a shaft extending along the axial direction and a head located at one end of the shaft. The bolt defines a lock-receiving feature along the shaft. The spacer defines a bolt cavity extending along the axial direction, and removably receives the shaft. The locking mechanism removably engages the bolt at the lock-receiving feature to secure the spacer to the bolt.

In another exemplary aspect of the present disclosure, a shipping spacer assembly is provided. The shipping spacer assembly may be configured to be removably attached to a rear panel of a washing machine appliance. The shipping spacer assembly may define an axial direction, a radial direction, and a circumferential direction. The shipping spacer assembly may include a bolt, a spacer, a locking mechanism, and a cord retention mechanism. The bolt may include a shaft extending along the axial direction, and a head located at one end of the shaft. The bolt may define a lock-receiving feature along the shaft. The spacer may define a bolt cavity extending along the axial direction, and may removably receive the shaft, the shaft aligned along the axial direction. The locking mechanism may be attached to the bolt at the lock-receiving feature. The cord retention mechanism may be located along the shaft of the bolt.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Use of the same of similar reference numerals in the figures denotes the same or similar features unless the context indicates otherwise.

DETAILED DESCRIPTION

Figure 1:
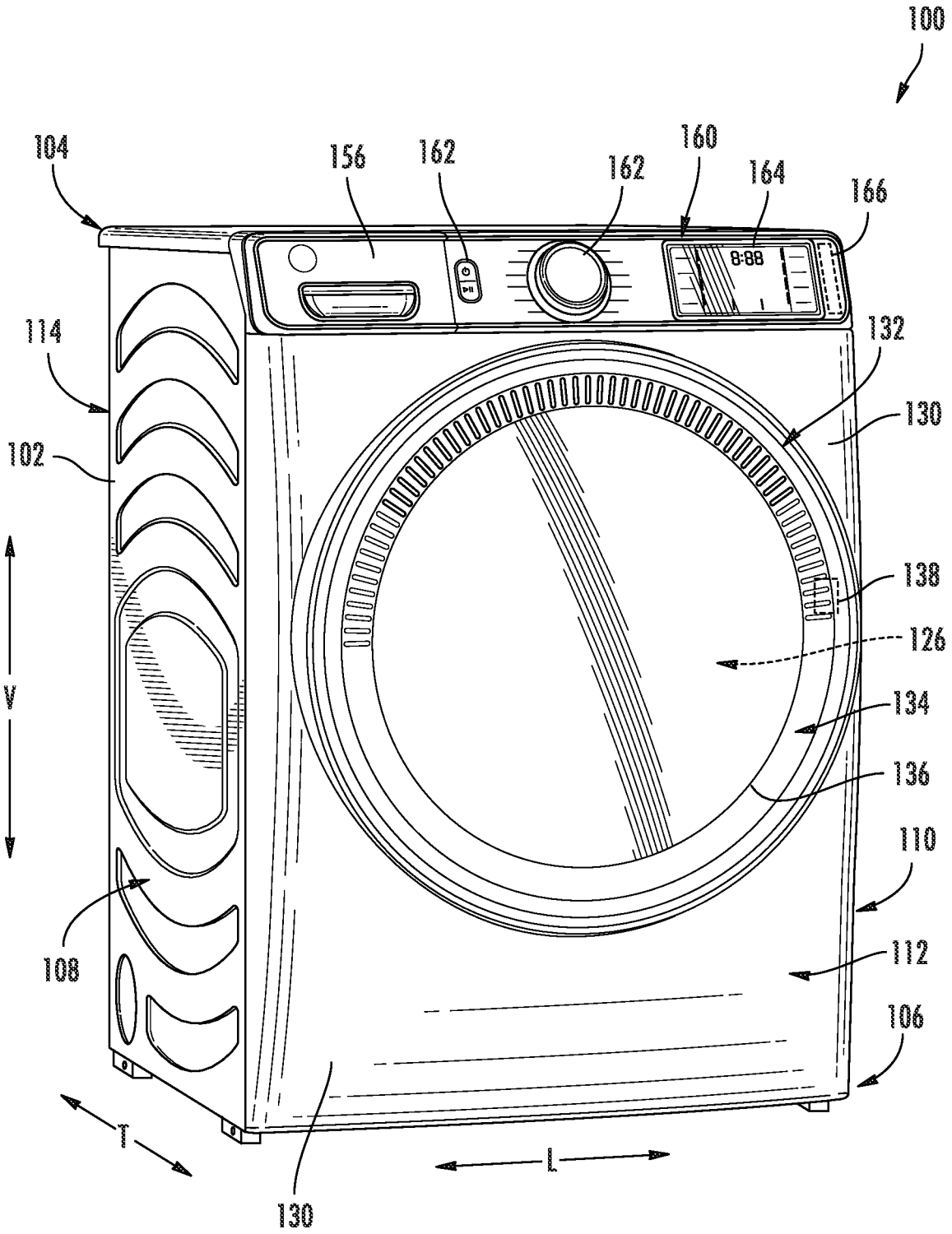
FIG. 1 provides a perspective view of a front load washing machine appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise, or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

The present invention advantageously provides a washing machine appliance that may provide a stable shipping situation, with a wash tub internal to the washing machine appliance secured during shipment. Further, the present invention may provide a way to remove mechanisms, including a spacer, used to secure the wash tub during shipment upon installation of the washing machine appliances. By attaching the spacer to a power cord of the washing machine appliance and making the power cord inaccessible without removal of the spacers from the washing machine, the chance of the spacers remaining in the washing machine after installation may be greatly reduced. By locking the spacer and a cord retention mechanism retaining the power cord on a bolt shaft screwed into the tub to secure it during shipment, and by requiring removal of the bolt and the spacer from the bolt in order to access the cord retention mechanism to release the power cord from the cord retention mechanism, the spacer and bolt may be removed from the appliance as a part of installation, without requiring an extra step. The use of fewer steps may advantageously result in fewer service calls from spacers left in washing machines after installation. Spacers left in washing machines after installation may lead to improper functioning of suspension systems within the washing machine and may lead to walking or movement of the washing machine appliance during use following installation. Removal of spacers as a part of attaching the washing machine to a power source may increase correct installation practices and decrease service calls or returns due to improper installation of the appliance.

Figure 2:
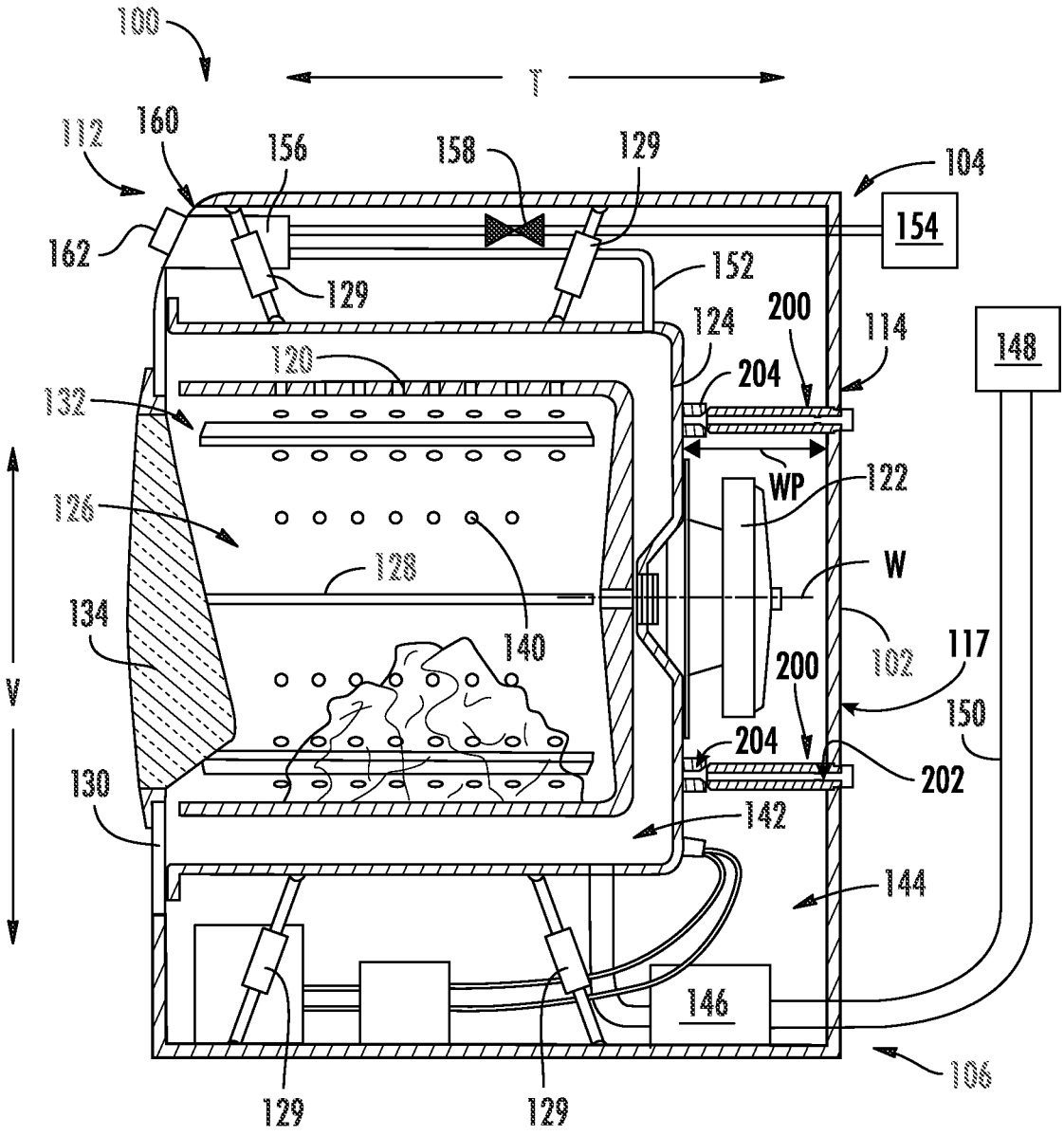
FIG. 2 provides a side cross section view of the exemplary washing machine appliance of FIG. 1.

Referring now to the figures, an exemplary laundry appliance that may be used to implement aspects of the present subject matter will be described. Specifically, FIG. 1 is a perspective view of an exemplary horizontal axis washing machine appliance 100 and FIG. 2 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined.

According to exemplary embodiments, washing machine appliance 100 includes a cabinet 102 that is generally configured for containing and/or supporting various components of washing machine appliance 100 and which may also define one or more internal chambers or compartments of washing machine appliance 100. In this regard, as used herein, the terms "cabinet," "housing," and the like are generally intended to refer to an outer frame or support structure for washing machine appliance 100, e.g., including any suitable number, type, and configuration of support structures formed from any suitable materials, such as a system of elongated support members, a plurality of interconnected panels, or some combination thereof. It should be appreciated that cabinet 102 does not necessarily require an enclosure and may simply include open structure supporting various elements of washing machine appliance 100. By contrast, cabinet 102 may enclose some or all portions of an interior of cabinet 102. It should be appreciated that cabinet 102 may have any suitable size, shape, and configuration while remaining within the scope of the present subject matter.

As illustrated, cabinet 102 generally extends between a top 104 and a bottom 106 along the vertical direction V, between a first side 108 (e.g., the left side when viewed from the front as in FIG. 1) and a second side 110 (e.g., the right side when viewed from the front as in FIG. 1) along the lateral direction L, and between a front 112 and a rear 114 along the transverse direction T. In general, terms such as "left," "right," "front," "rear," "top," or "bottom" are used with reference to the perspective of a user accessing washing machine appliance 100.

Referring to FIG. 2, a wash basket 120 is rotatably mounted within cabinet 102 such that it is rotatable about an axis of rotation W. A motor 122, e.g., such as a pancake motor, is in mechanical communication with wash basket 120 to selectively rotate wash basket 120 (e.g., during an agitation or a rinse cycle of washing machine appliance 100). Wash basket 120 is received within a wash tub 124 and defines a wash chamber 126 that is configured for receipt of articles for washing. The wash tub 124 holds wash and rinse fluids for agitation in wash basket 120 within wash tub 124. As used herein, "wash fluid" may refer to water, detergent, fabric softener, bleach, or any other suitable wash additive or combination thereof. Indeed, for simplicity of discussion, these terms may all be used interchangeably herein without limiting the present subject matter to any particular "wash fluid."

Wash basket 120 may define one or more agitator features that extend into wash chamber 126 to assist in agitation and cleaning articles disposed within wash chamber 126 during operation of washing machine appliance 100. For example, as illustrated in FIG. 2, a plurality of ribs 128 extends from basket 120 into wash chamber 126. In this manner, for example, ribs 128 may lift articles disposed in wash basket 120 during rotation of wash basket 120.

According to exemplary embodiments, wash tub 124 may be generally suspended within cabinet 102 by one or more suspension assemblies 129, e.g., as shown for example in FIG. 2. In this regard, wash tub 124, wash basket 120, motor 122, and other components of washing machine appliance 100 may be referred to generally herein as the subwasher. In order to reduce the transmission of vibrations and other forces from the subwasher to the cabinet 102 during operation of washing machine appliance 100, wash tub 124 may be generally isolated from cabinet 102 by suspension assemblies 129. This may be desirable to prevent undesirable noise, vibrations, "walking" of the appliance, etc. It should be appreciated that suspension assemblies 129 may generally include any suitable number and combination of springs, dampers, or other energy absorbing mechanisms to reduce the transmission of forces between the subwasher and cabinet 102. Although exemplary suspensions assemblies 129 are illustrated herein, it should be appreciated that the number, type, and configuration of suspension assemblies 129 may vary while remaining within the scope of the present subject matter.

Referring generally to FIGS. 1 and 2, cabinet 102 also includes a front panel 130 which defines an opening 132 that permits user access to wash basket 120 of wash tub 124. More specifically, washing machine appliance 100 includes a door 134 that is positioned over opening 132 and is rotatably mounted to front panel 130. In this manner, door 134 permits selective access to opening 132 by being movable between an open position (not shown) facilitating access to a wash tub 124 and a closed position (FIG. 1) prohibiting access to wash tub 124.

A window 136 in door 134 permits viewing of wash basket 120 when door 134 is in the closed position, e.g., during operation of washing machine appliance 100. Door 134 also includes a handle (not shown) that, e.g., a user may pull when opening and closing door 134. Further, although door 134 is illustrated as mounted to front panel 130, it should be appreciated that door 134 may be mounted to another side of cabinet 102 or any other suitable support according to alternative embodiments. Washing machine appliance 100 may further include a latch assembly 138 (see FIG. 1) that is mounted to cabinet 102 and/or door 134 for selectively locking door 134 in the closed position and/or confirming that the door 134 is in the closed position. Latch assembly 138 may be desirable, for example, to ensure only secured access to wash chamber 126 or to otherwise ensure and verify that door 134 is closed during certain operating cycles or events.

Referring again to FIG. 2, wash basket 120 also defines a plurality of perforations 140 in order to facilitate fluid communication between an interior of basket 120 and wash tub 124. A sump 142 is defined by wash tub 124 at a bottom of wash tub 124 along the vertical direction V. Thus, sump 142 is configured for receipt of and generally collects wash fluid during operation of washing machine appliance 100. For example, during operation of washing machine appliance 100, wash fluid may be urged by gravity from basket 120 to sump 142 through plurality of perforations 140.

A drain pump assembly 144 is located beneath wash tub 124 and is in fluid communication with sump 142 for periodically discharging soiled wash fluid from washing machine appliance 100. Drain pump assembly 144 may generally include a drain pump 146 which is in fluid communication with sump 142 and with an external drain 148 through a drain hose 150. During a drain cycle, drain pump 146 urges a flow of wash fluid from sump 142, through drain hose 150, and to external drain 148. More specifically, drain pump 146 includes a motor (not shown) which is energized during a drain cycle such that drain pump 146 draws wash fluid from sump 142 and urges it through drain hose 150 to external drain 148.

Washing machine appliance 100 may further include a wash fluid dispenser that is generally configured for dispensing a flow of water, wash fluid, etc. into wash tub 124. For example, a spout 152 is configured for directing a flow of fluid into wash tub 124. For example, spout 152 may be in fluid communication with a water supply 154 (FIG. 2) in order to direct fluid (e.g., clean water or wash fluid) into wash tub 124. Spout 152 may also be in fluid communication with the sump 142. For example, pump assembly 144 may direct wash fluid disposed in sump 142 to spout 152 in order to circulate wash fluid in wash tub 124.

As illustrated in FIG. 2, a detergent drawer 156 is slidably mounted within front panel 130. Detergent drawer 156 receives a wash additive (e.g., detergent, fabric softener, bleach, or any other suitable liquid or powder) and directs the fluid additive to wash tub 124 during operation of washing machine appliance 100. According to the illustrated embodiment, detergent drawer 156 may also be fluidly coupled to spout 152 to facilitate the complete and accurate dispensing of wash additive. It should be appreciated that according to alternative embodiments, these wash additives could be dispensed automatically via a bulk dispensing unit (not shown). Other systems and methods for providing wash additives are possible and within the scope of the present subject matter.

In addition, a water supply valve 158 may provide a flow of water from a water supply source (such as a municipal water supply 154) into detergent dispenser 156 and into wash tub 124. In this manner, water supply valve 158 may generally be operable to supply water into detergent dispenser 156 to generate a wash fluid, e.g., for use in a wash cycle, or a flow of fresh water, e.g., for a rinse cycle. It should be appreciated that water supply valve 158 may be positioned at any other suitable location within cabinet 102. In addition, although water supply valve 158 is described herein as regulating the flow of "wash fluid," it should be appreciated that this term includes, water, detergent, other additives, or some mixture thereof.

During operation of washing machine appliance 100, laundry items are loaded into wash basket 120 through opening 132, and washing operation is initiated through operator manipulation of one or more input selectors or using a remote device (see below). Wash tub 124 is filled with water, detergent, and/or other fluid additives, e.g., via spout 152 and/or detergent drawer 156. One or more valves (e.g., water supply valve 158) can be controlled by washing machine appliance 100 to provide for filling wash basket 120 to the appropriate level for the amount of articles being washed and/or rinsed. By way of example for a wash mode, once wash basket 120 is properly filled with fluid, the contents of wash basket 120 can be agitated (e.g., with ribs 128) for washing of laundry items in wash basket 120.

After the agitation phase of the wash cycle is completed, wash tub 124 can be drained. Laundry articles can then be rinsed by again adding fluid to wash tub 124, depending on the particulars of the cleaning cycle selected by a user. Ribs 128 may again provide agitation within wash basket 120. One or more spin cycles may also be used. In particular, a spin cycle may be applied after the wash cycle and/or after the rinse cycle in order to wring wash fluid from the articles being washed. During a final spin cycle, basket 120 is rotated at relatively high speeds and drain assembly 144 may discharge wash fluid from sump 142. After articles disposed in wash basket 120 are cleaned, washed, and/or rinsed, the user can remove the articles from wash basket 120, e.g., by opening door 134 and reaching into wash basket 120 through opening 132.

In certain embodiments, control panel 160, with at least one input selector 162, extends from front 112. Control panel 160 and input selector 162 collectively form a user interface input for operator selection of machine cycles and features. A display 164 of control panel 160 indicates selected features, operation mode, a countdown timer, or other items of interest to appliance users regarding operation. Operation of washing machine appliance 100 may be controlled by a controller 166 connected (e.g., electrically coupled) to control panel 160 for user manipulation to select washing machine cycles and features. In response to user manipulation of control panel 160, controller 166 operates the various components of washing machine appliance 100 to execute selected machine cycles and features.

Controller 166 may include a memory (e.g., non-transitive media) and microprocessor, such as a general or special purpose microprocessor operable to execute programming instructions or micro-control code associated with a selected machine cycles and features (e.g., as part of a washing operation). The memory may represent random access memory such as DRAM, or read only memory such as ROM or FLASH. In certain embodiments, the processor executes programming instructions stored in memory. The memory may be a separate component from the processor or may be included onboard within the processor. Alternatively, controller 166 may be constructed without using a microprocessor (e.g., using a combination of discrete analog or digital logic circuitry, such as switches, amplifiers, integrators, comparators, flip-flops, AND gates, and the like) to perform control functionality instead of relying upon software. Control panel 160 and other components of washing machine appliance 100 (e.g., one or more sensors, such as a pressure sensor mounted to tub 121) may be in communication with controller 166 via one or more signal lines or shared communication busses.

Figure 3:
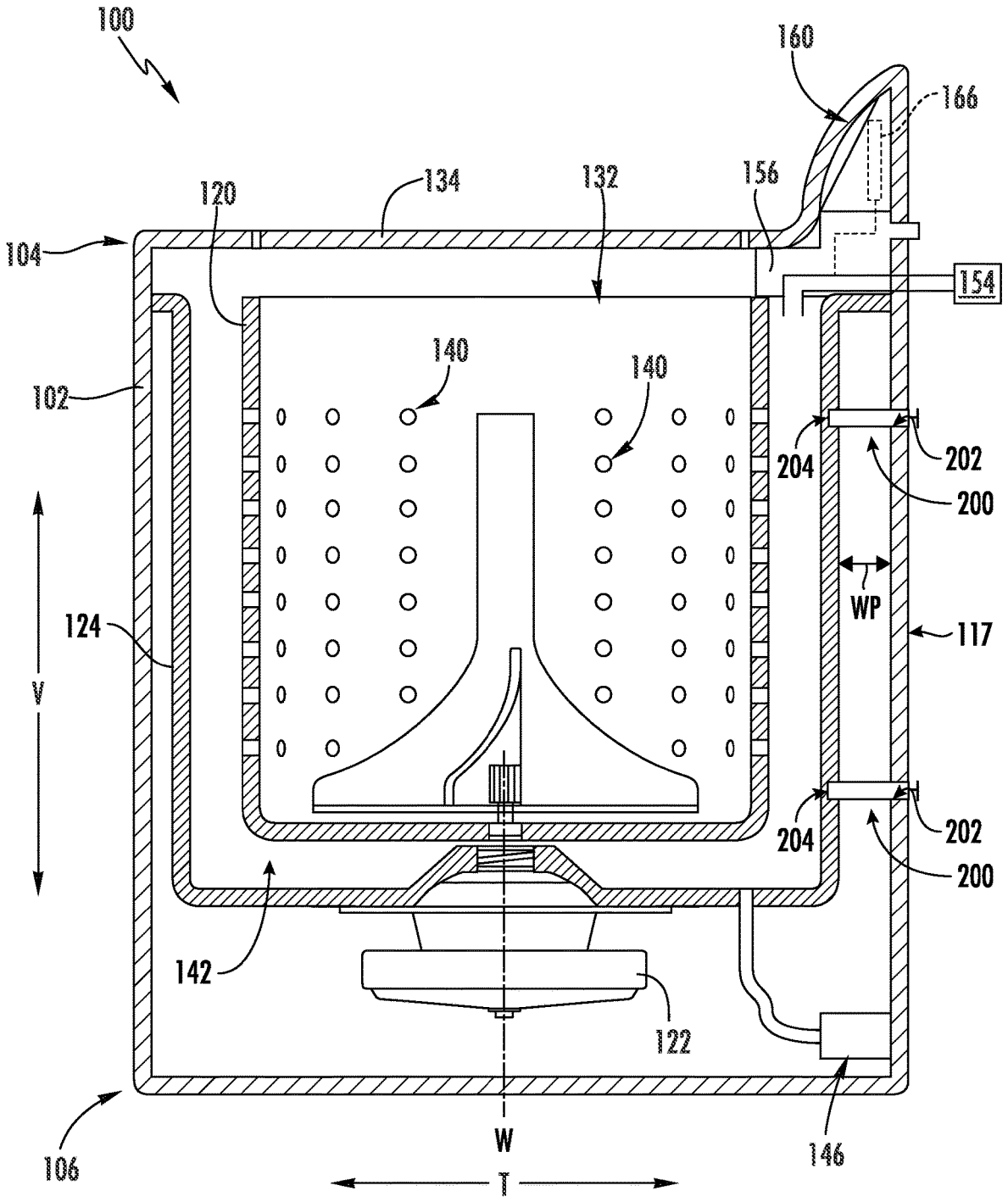
FIG. 3 provides a side cross section view of a top load washing machine appliance according to exemplary embodiments of the present disclosure.

FIG. 2 depicts a side section view of washing machine appliance 100 that is a front load washing machine. FIG. 3 depicts a side section view of a washing machine appliance that is a top load washing machine. Washing machine appliance 100 is shown in FIGS. 1 and 2 as a front loading washing machine, as an example. Other embodiments of a washing machine appliance may also be used in embodiments, such as a top loading washing machine (as shown in FIG. 3), a dryer appliance, or another household appliance where stabilization during shipping may be beneficial. Generally, features of washing machine appliance 100 will be described below, with the understanding that other embodiments may include or be provided as another suitable household appliance (e.g., defining an internal chamber). In addition, it should be appreciated that like reference numerals may be used to refer to the same or similar features between the washing machine appliances 100 illustrated in FIGS. 1 through 3.

As shown in FIGS. 2 and 3, a shipping spacer assembly 200 may be attached to wash tub 124. Rear panel 114 defines a spacer hole 202 extending therethrough in transverse direction T. Wash tub 124 further defines a bolt boss 204 extending into wash tub 124. Generally, shipping spacer assembly 200 is removably attached to wash tub 124 for fixing a distance WP between wash tub 124 and cabinet 102 in an installed position. In some embodiments, shipping spacer assembly 200 attaches to wash tub 124 by entering bolt boss 204, a portion of shipping spacer assembly 200 extending between rear panel 114 and wash tub 124. In other words, a portion of shipping spacer assembly 200 extends through spacer hole 202 and into bolt boss 204. Shipping spacer assembly 200 is configured to attach to wash tub 124 by removable receipt through spacer hole 202. Advantageously, fixing distance WP between wash tub 124 and cabinet 102 may allow the wash tub 124 to be rigidly fixed during transportation, preventing wear on suspension system 129 due to movement during transportation.

Figure 4:
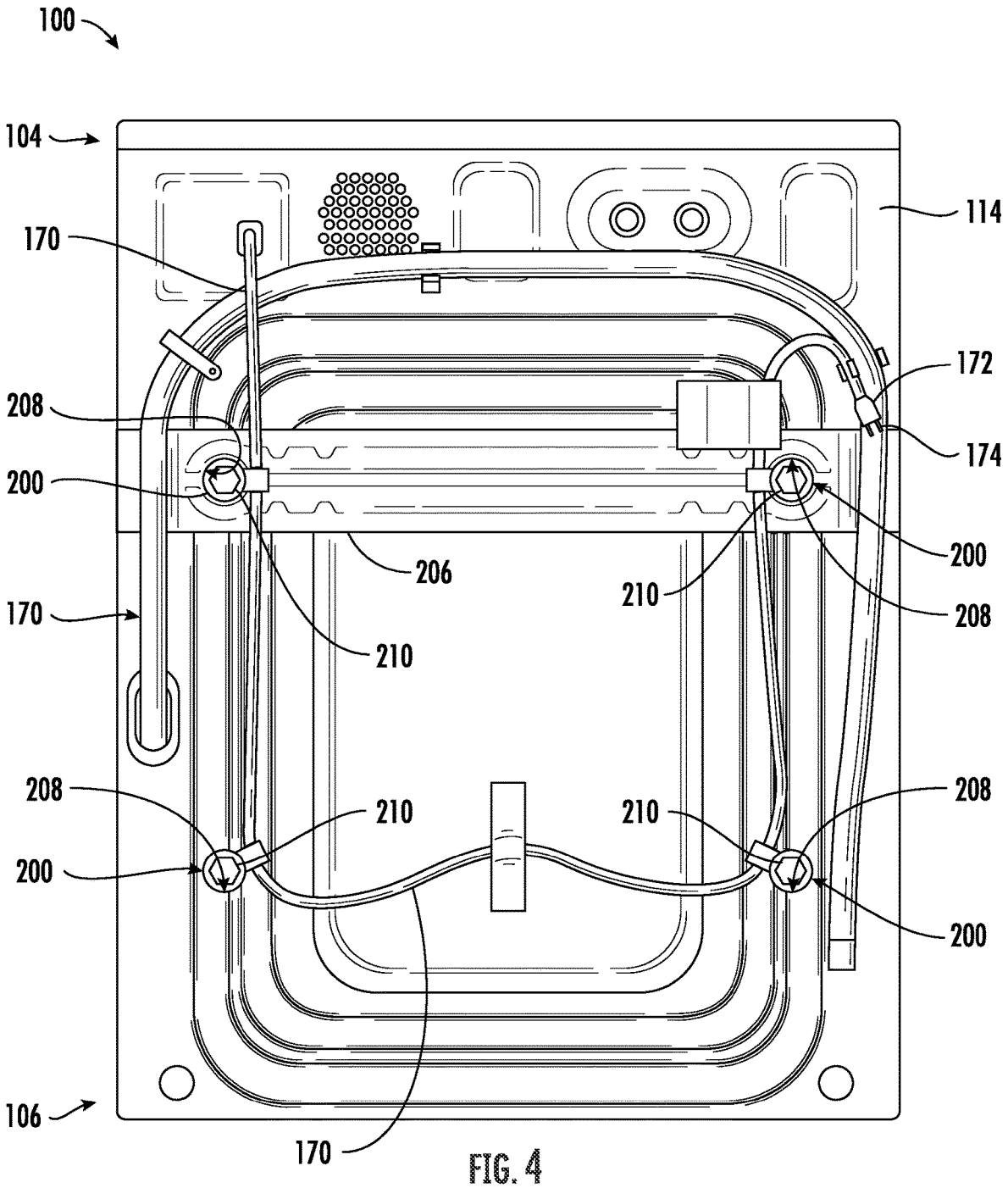
FIG. 4 provides a rear perspective view of the exemplary washing machine appliance of FIG. 1.
Figure 5:
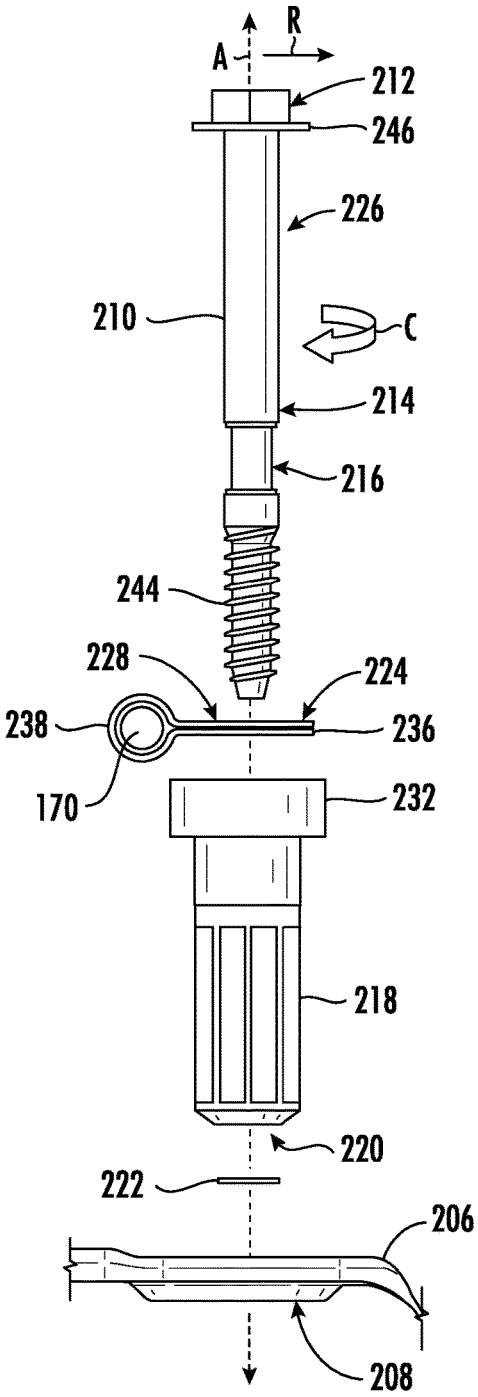
FIG. 5 provides an exploded perspective view of a shipping spacer assembly according to exemplary embodiments of the present disclosure.
Figure 6:
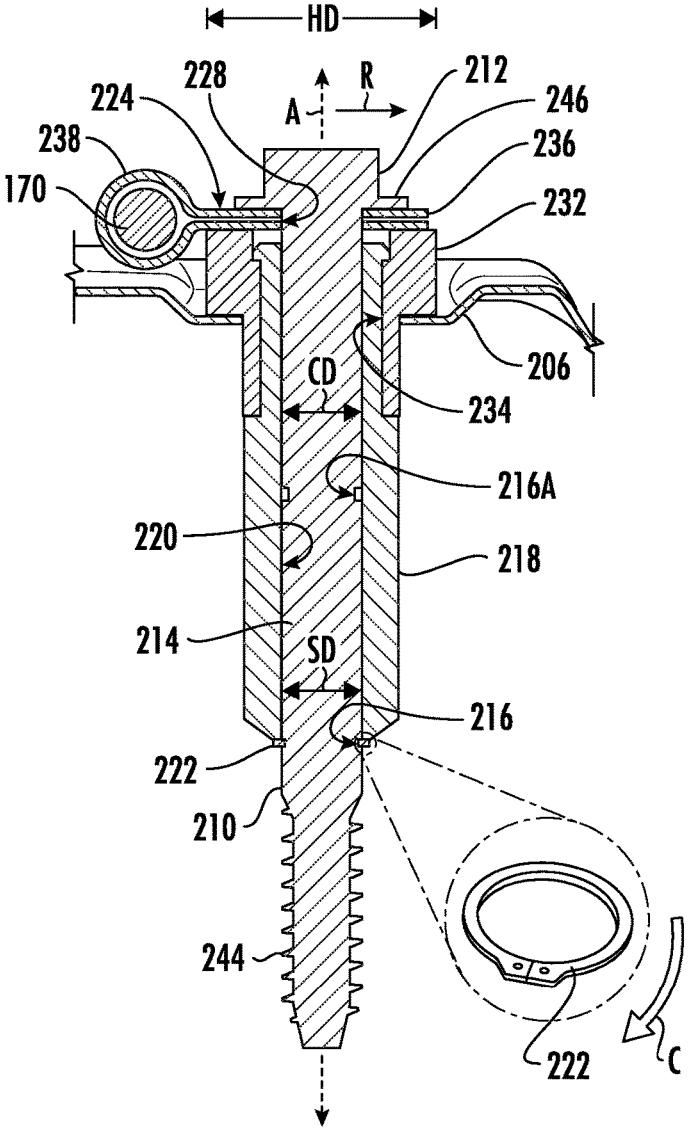
FIG. 6 provides a section view of the exemplary shipping spacer assembly of FIG. 4.
Figure 7:
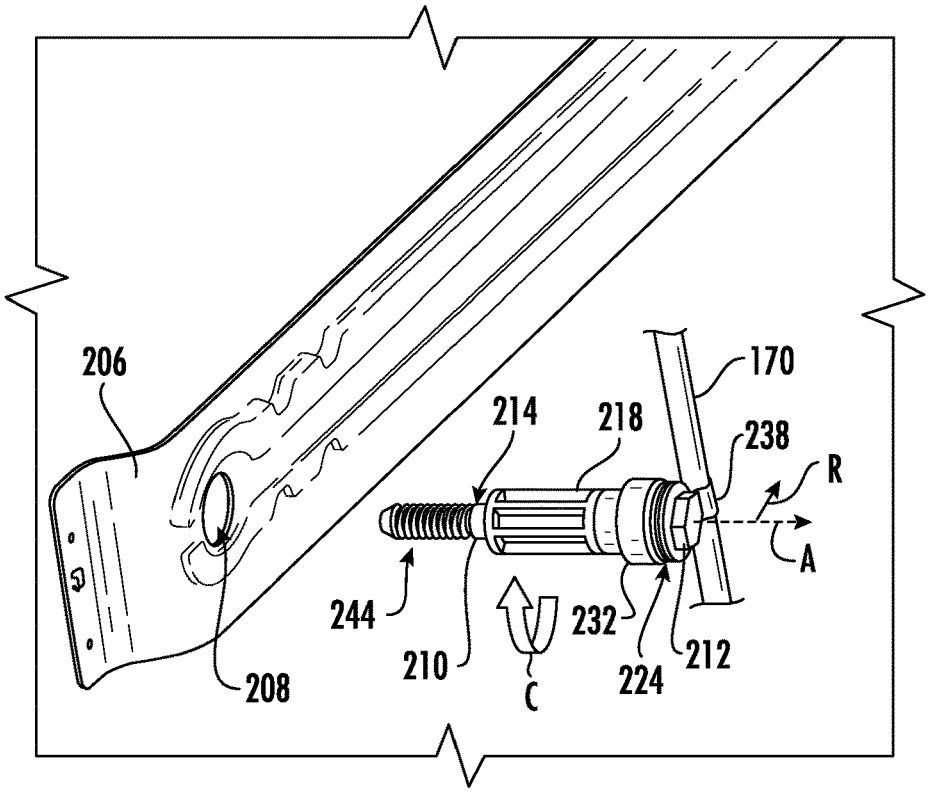
FIG. 7 provides a perspective view of an exemplary shipping spacer assembly and an exemplary retaining bar according to exemplary embodiments of the present disclosure.
Figure 8:
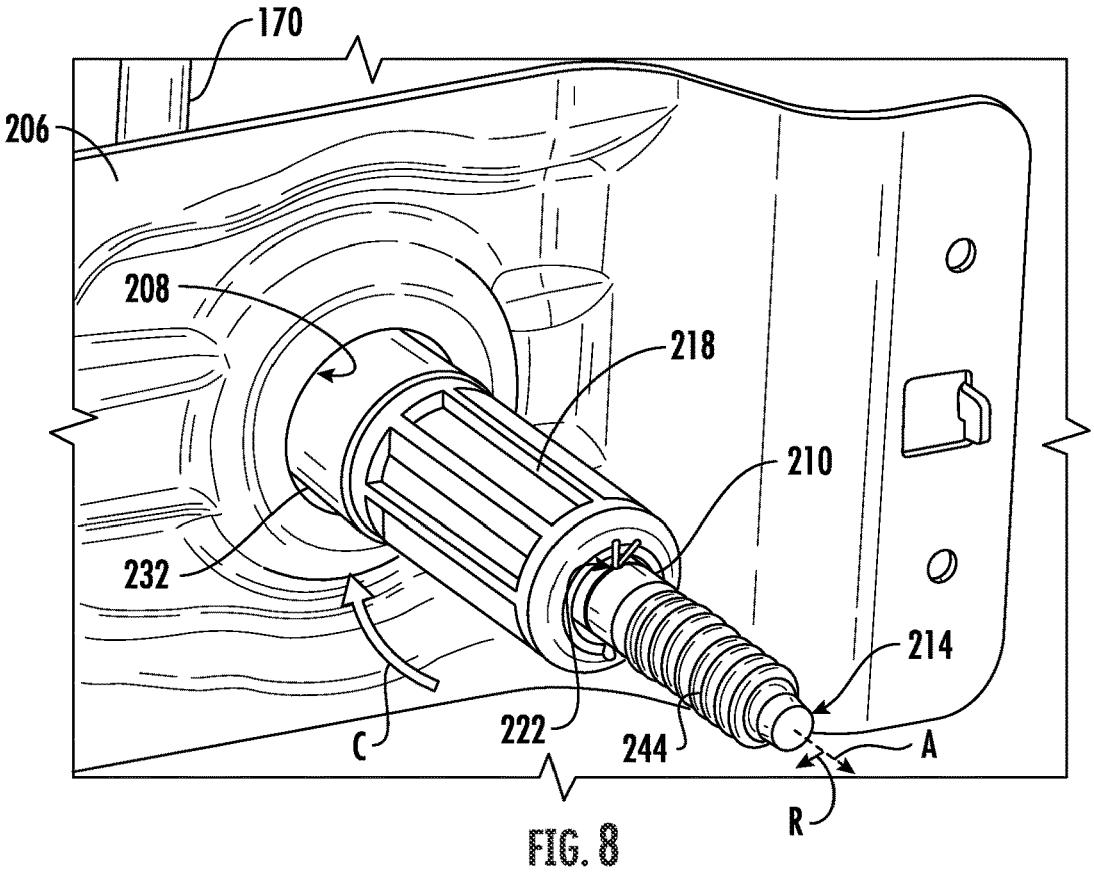
FIG. 8 provides an alternate perspective view of a portion of an exemplary shipping spacer assembly and a portion of an exemplary retaining bar according to exemplary embodiments of the present disclosure.

Turning to FIGS. 4 through 8, embodiments of shipping spacer assembly 200 are depicted, including an expanded view in FIG. 5, shipper spacer assemblies 200 in an installed position in FIGS. 4, 6, and 8, and shipper spacer assemblies 200 in an uninstalled position in FIG. 7.

Washing machine appliance 100 may further include a retention bar 206 located on rear panel 114. Generally, retention bar 206 is located transversely behind rear panel 114. Retention bar 206 extends along a length of rear panel 114. In some embodiments, and as shown in FIG. 4, retention bar 206 extends laterally along a portion of rear panel 118. Retention bar 206 may aid in stabilizing washing machine appliance 100 during transportation or during use. Retention bar 206 defines a retention aperture 208. Retention aperture 208 extends through retention bar 206. Retention aperture 208 is configured to removably receive shipping spacer assembly 200. For example, retention aperture 208 receives shipping spacer assembly 200 in installed position (which is shown in FIGS. 4, 6 and 8). Retention aperture 208 may align with spacer hole 202 or with bolt boss 204. For example, retention aperture 208, spacer hole 202 and bolt boss 204 may be aligned with one another in transverse direction T and in vertical direction V. Shipping spacer assembly 200 is configured to attach to wash tub 124 by removable receipt through retention aperture 208. Alternatively, retention bar 206 may not be used, with shipping spacer assembly 200 configured to attach directly to cabinet 102. For example, shipping spacer assembly 200 may be removably received directly at spacer hole 202 defined on rear panel 114. In some embodiments, a portion of shipping spacer assembly 200 may rest on an exterior side 117 of rear panel 114 adjacent to spacer hole 202 when a portion of shipping spacer assembly 200 is received in bolt boss 204 defined by wash tub 124.

As shown in FIGS. 5 and 6, shipping spacer assembly 200 defines an axial direction A, a radial direction R, and a circumferential direction C. Shipping spacer assembly 200 generally includes a bolt 210, and a feature for fixing distance WP between the wash tub 124 and cabinet 102 (e.g., a spacer 218), and a locking mechanism 222. In some embodiments, shipping spacer assembly 200 further includes a cord retention mechanism 224. Further, shipping spacer assembly 200 may include a grommet 232. Generally, elements other than bolt 210 of shipping spacer assembly 200 are removably received onto bolt 210 of shipping spacer assembly 200, as shown in FIGS. 5 and 6. Each of these features of shipping spacer assembly 200 will be described in more detail below.

Bolt 210 includes a shaft 214 extending along the axial direction A, a head 212 located at one end of shaft 214, and a threaded portion 244 located at an opposing end of shaft 214. For example, threaded portion 244 is located opposite head 212 of bolt 210 in the axial direction A. As shown, bolt 210 defines a lock-receiving feature 216 along shaft 214. Lock-receiving feature 216 may be in a position between threaded portion 244 and head 212. Bolt 210 is configured to be inserted into spacer hole 202 and attach to bolt boss 204, fixing distance WP between wash tub 124 and cabinet 102 of washing machine appliance 100.

Shaft 214 of bolt 210 generally includes a threaded portion 244. Threaded portion 244 extends in axial direction A opposite to head 212. Shaft 214 further defines the lock-receiving feature 216. In some embodiments, shaft 214 removably receives spacer 218, locking mechanism 222, cord retention mechanism 224, or grommet 232 of shipping spacer assembly 200 between head 212 and threaded portion 244. Shaft 214 may have a shaft diameter SD.

Threaded portion 244 is configured to be removably attached to wash tub 124. Threaded portion 244 removably attaches into bolt boss 204 of wash tub 124. Threaded portion 244 may be sized to fit inside bolt boss 204 or may extend from bolt boss 204 during attachment to wash tub 124. During use, threaded portion 244 is inserted through spacer hole 202 or retention aperture 208 to attach shipping spacer assembly 200 to bolt boss 204 of wash tub 124. In some embodiments, bolt boss 204 removably receives threaded portion 244 of bolt 210, which removably attaches shipping spacer assembly 200 to wash tub 124.

Head 212 of bolt 210 has a head diameter HD greater than shaft diameter SD. Head 212 is configured to hold elements of shipping spacer assembly 200 along shaft 214 when shipping spacer assembly 200 is attached thereto. In some embodiments, head 212 and locking mechanism 222 retain spacer 218, grommet 232, or cord retention mechanism 224 therebetween along the shaft 214. In other words, the head 212 aids in retaining spacer 218, grommet 232, or cord retention mechanism 224 along shaft 214 of bolt 210. In some embodiments, head 212 includes a flange 246, flange 246 attaching to shaft 214 of bolt 210. Flange 246 may extend beyond spacer 218 in radial direction R.

Lock-receiving feature 216 is defined along shaft 214 of bolt 210. Lock-receiving feature 216 is configured to removably receive locking mechanism 222. In some embodiments, and as shown in FIGS. 5 and 6, lock-receiving feature 216 includes or is provided as a groove located around shaft 214 in circumferential direction. In some embodiments, and as shown in FIG. 8, lock-receiving feature 216 includes or is provided as a hole located through shaft 214 in radial direction. Generally, lock-receiving feature 216 is configured for removable receipt of locking mechanism 222. When locking mechanism 222 is received by lock-receiving feature 216, elements of shipping spacer assembly 200 are locked onto shaft 214 of bolt 210.

In some embodiments, more than one groove (e.g., lock-receiving feature 216A) may be defined along shaft 214 of bolt 210 (e.g., as shown in FIG. 6). Such may be useful, for example, to provide for differing fixed distances between wash tub 124 and cabinet 102 of washing machine appliance models. In some embodiments, groove extends in axial direction A. Such may allow for adjustment of locking mechanism 222 to allow for varying fixed distances between wash tub 124 and cabinet 102. In other words, different washing machine appliance models may have different distances between cabinet 102 (e.g., at rear panel 114) and wash tub 124 (e.g., at bolt boss 204), and adjustable positioning of locking mechanism 222 by design of lock-receiving feature 216 may allow shipping spacer assembly 200 to be useful for more than one model of washing machine appliance. Receipt of locking mechanism 222 by lock-receiving feature 216 locks grommet 232, cord retention mechanism 224, or spacer 218 between head 212 and locking mechanism 222.

As previously stated, shipping spacer assembly 200 includes spacer 218. Spacer 218 is sized to fix a distance WP between wash tub 124 and rear panel 114. As shown in FIG. 3, spacer 218 extends between wash tub 124 and to rear panel 114. Spacer 218 may connect to wash tub 124 and rear panel 114. In other words, spacer 218 may be physically touching wash tub 124 and rear panel 114 during attachment of shipping spacer assembly 200 to wash tub 124.

In some embodiments, spacer 218 defines a bolt cavity 220. Bolt cavity 220 extends along axial direction A. Bolt cavity 220 removably receives shaft 214 of bolt 210. Generally, bolt cavity 220 is sized to fit shaft 214 of bolt 210, bolt cavity 220 defined as a space with a diameter CD smaller than diameter HD of head 212. Thus, during use or when shipping spacer assembly 200 is attached to washing machine appliance 100, spacer 218 is irremovable from shaft 214. In other words, bolt 210 is removable from spacer 218 and bolt cavity 220 by moving spacer 218 towards threaded portion 244 and restrained on shaft 214 by moving spacer 218 towards head 212. In some embodiments, spacer 218 is located along shaft 214 between head 212 and lock-receiving feature 216 along shaft 214. In certain embodiments, spacer 218 is further located between cord retention mechanism 224 and lock-receiving feature 216 along the shaft 214. Spacer 218 is generally located between head 212 and threaded portion 244.

Shipping spacer assembly 200 also includes locking mechanism 222. Locking mechanism 222 removably engages bolt 210 at lock-receiving feature 216 to secure spacer 218 to the bolt 210. As shown in FIGS. 5 and 6, locking mechanism 222 may be a clip engaging a groove (e.g., lock-receiving feature 216). Locking mechanism 222 as a clip may surround at least a majority of a circumference at lock-receiving feature 216. Examples of locking mechanism 222 include a locking clip or a locking ring, including a circlip, a c-clip, a plastic clip, a ring, a metal clip, a snap clip, a plastic ring, a metal ring, a composite ring, or equivalents. Locking mechanism 222 may lock onto shaft 214 at lock-receiving feature 216 and may be removable from shaft 214.

As shown in FIG. 8, locking mechanism 222 may be a pin engaging a hole (e.g., lock-receiving feature 216). Locking mechanism 222 may be received through lock-receiving feature 216, extending therethrough. Examples of locking mechanism 222 as a pin include a locking pin or a retaining cable. A locking pin may be a straight pin, a cotter pin, a split pin, a parallel pin, a spring pin, a groove pin, a ball lock pin, a socket pin, a clamping pin, or an equivalent structure extending through shaft 214 at lock-receiving feature 216 to lock elements on the shaft 214 between the head 212 and the locking mechanism 222.

In some embodiments, locking mechanism 222 and lock-receiving feature 216 are located before the threaded portion 244 of shaft 214. Locking mechanism 222 locks spacer 218 and cord retention mechanism 224 along shaft 214. Spacer 218 and cord retention mechanism 224 are located along shaft 214 between locking mechanism 222 and head 212. During use, locking mechanism 222 locks spacer 218 or cord retention mechanism 224 along shaft 214. Thus, shipping spacer assembly 200 may be removed or attached to cabinet 102 as an attached assembly, the spacer 218 or cord retention mechanism 224 remaining attached on the shipping spacer assembly 200 during removal of shipping spacer assembly 200 from washing machine appliance 100. Advantageously, removal of shipping spacer assembly 200 from washing machine with spacer 218 or cord retention mechanism 224 staying locked or remaining attached to shaft 214 allow the spacer 218 to be removed with the bolt 210. Embodiments may reduce or eliminate the instance of spacer 218*s* being left in washing machine appliances following installation of the appliance after transportation.

Generally, cord retention mechanism 224 is located along shaft 214 of bolt 210. Cord retention mechanism 224 includes a connecting tab 236 defining a shaft aperture 228 and a cord retention clip 238. As shown in FIGS. 5 and 6, cord retention clip 238 extends from connecting tab 236. Thus, connecting tab 236 removably receives shaft 214 at shaft aperture 228. In this regard, cord retention clip 238 extends adjacent to shaft 214 and is configured to receive a portion of power cord 170. Cord retention clip 238 receives a portion of power cord 170, holding power cord 170 against rear panel 114. In some embodiments, connecting tab 236 may be a two piece tab, with cord retention clip 238 connecting each piece of the two piece tab. The power cord 170 may be in clip 238, sandwiched between each piece of the two piece tab, encasing a portion of power cord 170. In some embodiments, cord retention mechanism 224 may be made of metal or another material difficult to cut. In this manner, a user attempting to remove the power cord would be encouraged to remove the shipping spacer assembly instead of attempting to cut the cord retention clip. Advantageously, removal of the power cord by removal of the shipping spacer assembly may avoid or decrease the instance of bolts or spacers left in the washing machine during use.

Advantageously, power cord 170 is contained in cord retention clip 238 during transportation. Further, power cord 170 must be removed from cord retention clip 238 to connect power cord 170 to the external power source. Advantageously, requiring removal of the shipping spacer assembly 200 in order to use power cord 170 of appliance may lead to removal of shipping spacer assembly 200, including spacer 218, prior to use of washing machine appliance, which, in turn, may lead to a reduction of service calls, or improper leaving of shipping spacer assembly 200 or spacer 218 within washing machine appliance 100 during use. Additionally or alternatively, suspension system 129 may be able to perform its function during use following removal of shipping spacer assembly 200 and may be preserved during transportation by using shipping spacer assembly 200 during transport.

Grommet 232 of shipping spacer assembly 200 may define a grommet cavity 234. Grommet 232 is located along shaft 214 between head 212 and spacer 218. Shaft 214 is removably received through grommet cavity 234. Additionally or alternatively, grommet 232 may be located along shaft 214 between head 212 and threaded portion 244. In some embodiments, grommet 232 touches head 212. Grommet 232 may be attached to spacer 218. Such may include or be provided as a unitary feature. In some embodiments, and as shown in FIG. 6, grommet cavity 234 may receive a portion of spacer 218 as well as shaft 214. Spacer 218 may extend from grommet 232 behind retention bar 206 or rear panel 114 at spacer hole 202 or retention aperture 208. As shown installed in FIG. 6, at least a portion of grommet 232 may be external to rear panel 114 when shipping spacer assembly 200 is attached to wash tub 124. Additionally or alternatively, grommet 232 may be external to retention bar 206. In some embodiments, grommet 232 is affixed to spacer 218.

Advantageously, grommet 232 affixed to spacer 218 may promote removal of shipping spacer assembly 200 as grommet 232 visibly needs to be removed in order to access cord retention mechanism 224 or power cord 170, indicating to the person installing the appliance that the bolt 210 needs to be removed, and spacer 218 is attached to grommet 232, so it will be removed with grommet 232.

Generally, shipping spacer assembly 200 is configured for receipt of power cord 170. Power cord 170 may be removable from shipping spacer assembly 200 only upon removal of cord retention mechanism 224, spacer 218, and locking mechanism 222 from shaft 214 of bolt 210. Additionally or alternatively, bolt 210 may be removed from wash tub 124 and rear panel 114 in order to remove power cord 170. Fully assembled, shipping spacer assembly 200 may have cord retention mechanism 224 next to head 212 and grommet 232. Grommet 232 may be next to cord retention mechanism 224 and spacer 218. Spacer 218 may be next to grommet 232 and locking mechanism 222. Locking mechanism 222 may be next to spacer 218 and threaded portion 244. In some embodiments, threaded portion 244 is received in bolt boss 204.

As shown in FIG. 6, head 212, grommet 232 and cord retention mechanism 224 of bolt 210 are located external to rear panel 114. Additionally or alternatively, head 212, grommet 232 and cord retention mechanism 224 of bolt 210 are located external to retention bar 206. As shown in FIGS. 6 and 8, spacer 218 and thread portion of bolt 210 are located internal to washing machine appliance 100, spacer 218 fixing distance WP between rear panel 114 and wash tub 124.

In some embodiments, and as shown in FIG. 4, washing machine appliance 100 may comprise at least two shipping spacer assemblies 200. Each shipping spacer assembly 200 may be removably attached to rear panel 114. Rear panel 114 may define at least two spacer holes 202. In certain embodiments, washing machine appliance 100 may comprise four shipping spacer 218 assemblies with rear panel 114 defining four spacer holes 202. There may be a corresponding number of spacer holes 202 to shipping spacer assemblies 200. Each shipping spacer assembly 200 of washing machine appliance 100 may be removably attach to rear panel 114 at each respective spacer hole 202. A portion of each shipping spacer assembly 200 may be located between rear panel 114 and wash tub 124, as shown in FIG. 3.

Embodiments described herein may further relate to safety improvements in washing machine appliances, including front and top load washing machine appliances, by ensuring the removal of shipping bolts and spacers using a circlip or a retaining clip mechanism. Generally, a shipping bolt assembly or shipping spacer assembly may include four parts: a shipping bolt, a washer, a shipping spacer, and a power cord retaining mechanism. This shipping bolt assembly may be used to arrest the free motion of a suspended sub washer system during shipment to prevent damage and may ensure the safe handling of the washer appliance during shipping. During operation or in running condition, the sub washer, including the wash tub and wash basket, may be required to swing freely. Therefore it may be advantageous to remove the shipping bolts and shipping spacers before use of the washing machine appliance. Hence, an advantage of this invention may be to ensure that the shipping bolts and shipping spacers are removed after immediate installation of the appliance.

In some embodiments, shipping bolt assembly is removed as a single piece, which may avoid the shipping spacer left in the appliance after installation of the appliance. The bolt having a lock-receiving feature may be inserted into a cord retention mechanism, spacer and followed by the locking mechanism. The locking mechanism may be attached to the lock-receiving feature. In some embodiments, this may include a circlip snapped on the groove of the bolt. The groove may allow an up and down motion of the spacer while fastening the bolt on the washer tub via retention bar. In some embodiments, when the user attempts to remove the power cord during the installation; this bolt assembly indicates the user to remove all bolts to access the power cord which is coupled with all four bolts. As the power cord retaining clip is made up of metal or other strong material, it may not be snipped. Hence, the user is prompted to unscrew all the four bolts to release the power cord. While unscrewing and removing each bolt from the appliance, the locking mechanism present on the lock-receiving feature of the bolt pushes the spacer to come out of the appliance with the bolt. Thus, the spacer remaining with the appliance may be avoided and also may decrease or eliminate a chance for the spacer to fall inside the machine during removal of the bolt. Advantageously embodiments described herein may decrease or eliminate a service call rate due to appliance walking or vibration due to spacer left in the appliance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

a cabinet having a rear panel;

a wash tub located within the cabinet; and a shipping spacer assembly removably attached to the wash tub for fixing a distance between the wash tub and the cabinet in an installed position, the shipping spacer assembly defining an axial direction, a radial direction and a circumferential direction, the shipping spacer assembly comprising:

a bolt comprising a shaft extending along the axial direction and a head located at one end of the shaft, the bolt defining a plurality of lock-receiving features along the shaft, a spacer defining a bolt cavity extending along the axial direction and removably receiving the shaft, and a locking mechanism removably engaging the bolt at one of the plurality lock-receiving features to secure the spacer to the bolt.

2. The washing machine appliance of claim 1, the shipping spacer assembly further comprising a cord retention mechanism located along the shaft of the bolt.

3. The washing machine appliance of claim 2, further comprising a power cord configured to connect the washing machine appliance to an external power source, wherein the cord retention mechanism comprises a connecting tab defining a shaft aperture and a cord retention clip extending from the connecting tab, wherein the shaft is removably received through the shaft aperture of the cord retention mechanism, and wherein a portion of the power cord is received through the cord retention clip.

4. The washing machine appliance of claim 3, wherein the power cord is removable from the shipping spacer assembly only upon removal of the cord retention mechanism, the spacer, and the locking mechanism from the shaft of the bolt.

5. The washing machine appliance of claim 2, wherein the cord retention mechanism is located between the head and the spacer along the shaft.

6. The washing machine appliance of claim 2, wherein the spacer is located between the cord retention mechanism and at least one of the plurality of lock-receiving features along the shaft.

7. The washing machine appliance of claim 2, wherein the shipping spacer assembly further comprises a grommet defining a grommet cavity, the shaft removably received through the grommet cavity, the grommet located along the shaft between the head and the spacer.

8. The washing machine appliance of claim 7, wherein the grommet is attached to the spacer.

9. The washing machine appliance of claim 7, wherein the rear panel defines a spacer hole, and wherein the head, the grommet, and the cord retention mechanism of the bolt are located external to the rear panel, and wherein the spacer, the plurality of lock-receiving features, and the locking mechanism are located internal to the rear panel when in an installed position.

10. The washing machine appliance of claim 1, wherein each of the plurality of lock-receiving features is a groove located around the shaft in the circumferential direction and the locking mechanism comprises or is provided as a locking clip or a locking ring.

11. The washing machine appliance of claim 1, wherein each of the plurality of lock-receiving features is a hole located through the shaft in the radial direction that receives the locking mechanism, the locking mechanism comprising or being provided as a locking pin.

12. The washing machine appliance of claim 2, wherein the locking mechanism locks the spacer and the cord retention mechanism along the shaft, the spacer and the cord retention mechanism located along the shaft between the locking mechanism and the head.

13. The washing machine appliance of claim 1, wherein the bolt further comprises a threaded portion, the threaded portion located opposite to the head of the bolt in the axial direction, and wherein the wash tub defines a bolt boss removably receiving the threaded portion of the bolt, the shipping spacer assembly further removably attached to the wash tub.

14. The washing machine appliance of claim 1, further comprising a retention bar extending along a length of the rear panel and defining a retention aperture that removably receives the shipping spacer assembly.

15. The washing machine appliance of claim 1, wherein the rear panel defines at least two spacer holes, wherein the washing machine appliance further comprises at least two shipping spacer assemblies removably attached to the rear panel, and wherein each shipping spacer assembly is removably attached to the rear panel at each respective spacer hole, a portion of each shipping spacer assembly located between the rear panel and the wash tub.

16. A shipping spacer assembly configured to be removably attached to a rear panel of a washing machine appliance, the shipping spacer assembly defining an axial direction, a radial direction, and a circumferential direction, the shipping spacer assembly comprising:

a bolt comprising a shaft extending along the axial direction, and a head located at one end of the shaft, the bolt defining a plurality of lock-receiving features along the shaft;

a spacer defining a bolt cavity extending along the axial direction and removably receiving the shaft, the shaft aligned along the axial direction;

a locking mechanism attached to the bolt at one of the plurality of lock-receiving features; and a cord retention mechanism located along the shaft of the bolt.

17. The shipping spacer assembly of claim 16, further configured for receipt of a power cord configured to connect the washing machine appliance to an external power source, wherein the cord retention mechanism comprises a connecting tab defining a shaft aperture and a cord retention clip extending from the cord retention mechanism, wherein the shaft is removably received through the shaft aperture of the cord retention mechanism, wherein the cord retention clip is configured to receive a portion of the power cord.

18. The shipping spacer assembly of claim 16, wherein the cord retention mechanism is located between the head and the spacer along the shaft, and wherein the spacer is located between the cord retention mechanism and at least one of the plurality of lock-receiving features along the shaft.

19. The shipping spacer assembly of claim 16, wherein each of the plurality of lock-receiving features comprises or is provided as a groove located around the shaft in the circumferential direction or as a hole located through the shaft in the radial direction, and the locking mechanism comprises or is provided as a locking clip, a locking ring, or a locking pin.

20. The shipping spacer assembly of claim 16, wherein the locking mechanism locks the spacer and the cord retention mechanism along the shaft, the spacer and the cord retention mechanism located along the shaft between the locking mechanism and the head in the axial direction.

* * * * *